United States Patent [19]

Matsui et al.

[11] Patent Number: 4,459,128

[45] Date of Patent: Jul. 10, 1984

[54] PILE ARTICLES AND A METHOD FOR PRODUCING THE PILE ARTICLES

[75] Inventors: Masao Matsui, Takatsuki; Kazuo Okamoto; Takao Osagawa, both of Osaka, all of Japan

[73] Assignees: Kanebo, Ltd., Tokyo; Kanebo Synthetic Fibers Ltd., Osaka, both of Japan

[21] Appl. No.: 346,714

[22] Filed: Feb. 8, 1982

[51] Int. Cl.[3] ..... D06B 1/00; D06Q 1/02; D06L 3/00

[52] U.S. Cl. ..... 8/102; 8/114.6; 8/151; 8/158; 8/929; 68/200; 68/204

[58] Field of Search ..... 8/151, 158, 929, 114.6, 8/102; 68/200, 204

[56] References Cited

U.S. PATENT DOCUMENTS 4,173,452 11/1979 Fleissner ..... 8/929
4,189,302 2/1980 Toland ..... 8/929
4,332,585 6/1982 Minemura et al. ..... 8/114.6

FOREIGN PATENT DOCUMENTS 54-38234 11/1979 Japan ..... 8/929
56-15485 2/1981 Japan ..... 8/929

*Primary Examiner*—Maria Parrish Tungol
*Attorney, Agent, or Firm*—Flynn, Thiel, Boutell & Tanis

[57] ABSTRACT

Pile articles, such as artificial furs, wherein at least a part of piles is colored in at least two kinds of colorations which vary in the length direction of the piles, said color variation being caused on level surfaces distant substantially constantly from a substrate fabric of said pile articles over a broad area of said pile articles, are produced by rotating a fibrous structure having piles fixed on a rotating body to raise the piles owing to centrifugal force caused by the rotation and contacting the raised piles with a treating liquid for fibers retained in a rotary container wherein a cylindrical interface of the treating liquid is formed due to the centrifugal force. The pile articles wherein the piles are uniformly gradationally colored in the length direction of the piles are also produced by gradually moving the above described level surface.

30 Claims, 9 Drawing Figures

PILE ARTICLES AND A METHOD FOR PRODUCING THE PILE ARTICLES

BACKGROUND OF THE INVENTION

The present invention relates to pile articles, particularly articles having piles which are varied in color in the length direction and a method for producing the pile articles.

Fibrous products having piles, such as cut piles or loop piles have unique various appearances and feelings and are broadly used. One object of production of these pile articles is to obtain fur-like articles. However, as well-known, natural furs have very complicated, delicate and high grade of colors and structures and the artificial production thereof has been substantially impossible. For example, most natural furs have precise piles having different finenesses (diameters) and colors at the root portion, middle portion and top portion. Heretofore, it has been proposed to penetrate a dyestuff from back of a substrate fabric in order to dye the root portion of the piles of the pile articles, to apply a sizing agent containing a dyestuff, for example, a printing paste to the top portion of the piles with a roller, etc. in order to dye the top portion or dip the top portion of the piles in a dyeing solution. But, in these methods, it is very difficult and practically impossible to apply the dyestuff uniformly over a broad area of the pile articles so as to satisfy the object.

For example, in the method wherein a dyeing solution is penetrated from the back of the substrate fabric or only the top of the piles is dipped in the dyeing solution, the uniform and controlled dyeing is very difficult. This is because in the pile articles, the piles are contacted with one another or bundled and capillary tubes are formed therebetween and the dyeing solution is irregularly diffused and penetrated into undesired positions due to the capillary phenomenon and contamination is caused. When the viscosity of the dyeing solution is increased by using a paste agent in the dyeing solution in order to prevent the capillary phenomenon, it is very difficult to apply such a high viscosity solution to the piles which can easily fall down over a broad area of the pile fabric uniformly and at desired positions. Thus, in the prior art, even if various color variations are given only to some part of the piles, at other parts, the color variation often becomes different and the colored state where the color tone is varied, is local and the color variation is not uniform over the whole pile article or a broad area.

SUMMARY OF THE INVENTION

An object of the present invention is to provide novel pile articles wherein the color variation of the piles is uniform over the whole pile articles or a broad area of the pile articles.

Another object of the present invention is to provide a novel method for easily producing such pile articles.

The pile articles of the present invention are characterized in that at least one part of the piles has at least two color tones which vary in the length direction of the pile and the color variation is made by at least one level surface spaced a substantially constant distance from the substrate fabric over a broad area of the pile article.

DESCRIPTION OF THE PREFERRED EMBODIMENTS

Figure 1:
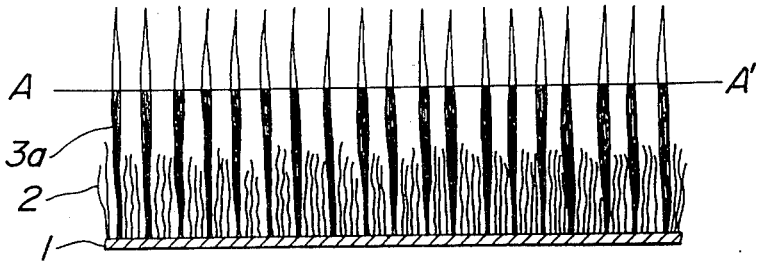
FIG. 1 to FIG. 6 are schematic views of cross-sections of pile articles of the present invention, respectively.

The term "color varied state" used herein means the state where the color is varied in the length direction of the piles, for example, the state where the top portion, the middle portion or the root portion is colored in a color tone different from the other portions. The term "different color tone" means that the hue, chroma or lightness (value) are different to such an extent that they are distinguishable by the naked eye, for example, there is difference of more than 2.5 in the hue, more than 2 in the chroma or more than 1 in the lightness in Munsell indication. The term "over a broad area of the pile article" used herein is not limited to a part of the pile articles but means the main portion, for example, an area of more than 50% (area), preferably more than 70%, more preferably more than 80% of said article. Of course, the products of the present invention include the articles wherein all portions have the uniform color tone. But the present invention includes the product having different color tone and appearance depending upon the portion. Such a two dimensional color distribution is obtained by varying the distribution state where two or more kinds of piles having colors varied in the length direction are two dimensionally arranged. For example, when two kinds of piles consisting of piles A wherein the top end portion is white and the other portion is black and piles B which are brown from the top end portion to the root portion, are arranged by varying the distribution state respectively, some parts of the product are larger in the ratio of the piles A and show a white rich appearance and another parts are larger in the ratio of the piles B and show a brown rich appearance. However, the piles A have the uniform colored state wherein the top portion is always white and the other portion is black at every portion of the product, and the piles B have the uniform colored state that the entire is brown in every portion of the product. In this manner, by combining two or more kinds of piles having different colored states and varying the two dimensional distribution of at least one kind of the piles, products having two-dimensionally varied appearance and color, for example, the products having highly varied appearances, such as a large number of natural animal furs, for example, fox, raccoon, dog, marten, etc. can be obtained.

Even in such highly varied products, the same kind of piles forming these products must be uniform. Even if plurals kind of irregularly colored piles are arranged in variation, only a wholly disturbed impression and a cloudy color are obtained. Furthermore, it is difficult to obtain products having colors and appearances which coincide with various designs and plans. In order to obtain the products satisfying the object and intention, it is most effective to combine one or more kinds of piles having the uniform colored state and control the arrangement (distribution). There are a variety of means by which such color variation in appearance is obtained intentionally according to plan. For example, when pile fabrics are produced through sliver knitting, pile weaving, pile knitting or tufting, two or more kinds of fibers having different coloring ability, dyeability or decoloring ability are combined by means of Jacquard machine to form a fabric having a desired pattern and then, if necessary said fabric is dyed.

The color variation in the length direction of the piles is classified into a sudden color variation in which the variation occurs in a relatively short distance and a gradational color in which the variation occurs gradually along a relatively long distance.

Firstly, an explanation will be made with respect to the sudden color variation.

Figure 2:
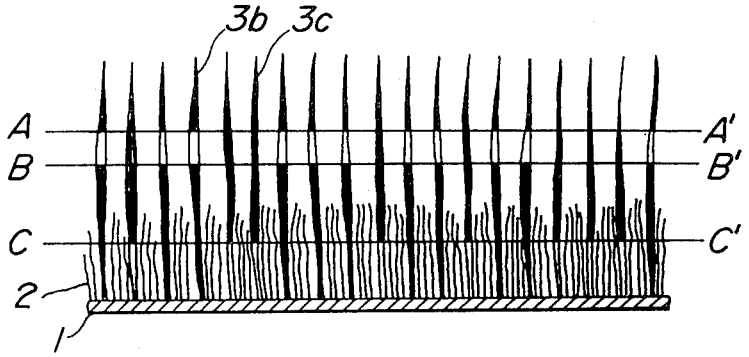
Figure 3:
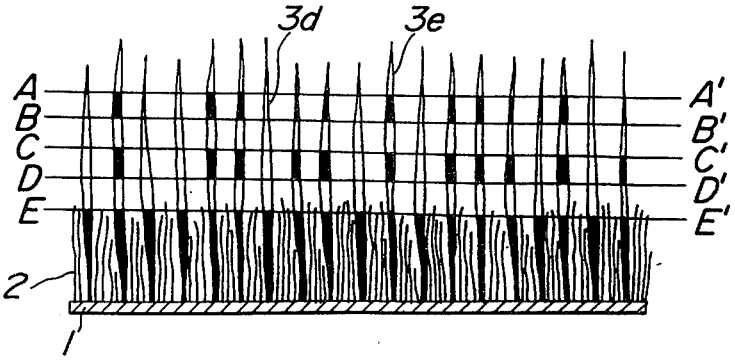

FIG. 1 to FIG. 3 are schematic views (cross-section) showing embodiments of the pile articles of the present invention in which the color of the piles is suddenly varied. In these drawings, a substrate fabric 1 is densely flocked with fine short wools 2 and long guard hairs 3*a* having a large fineness (diameter), the number of which is small. As the flocking method, electric flocking method, pile weaving or knitting method, sliver knitting method, tufting methd, combination of these methods every other method for producing pile articles can be applied. It has been well-known that many natural furs have double structure of wools and guard hairs and even in artificial pile articles, it is desired to have the double structure of wools and guard hairs. Of course, the present invention includes the pile articles having only one kind of piles and the pile articles having the double structure consisting of wools and guard hairs. In general, the fineness of wools is less than 5 d, particularly less than 3 d, in many cases 0.5–2 d (wools of less than 0.5 d may be produced and are useful), and in most case the wools are crimped and the density is 1,000–100,000 filaments/cm$^2$, preferably 10,000–50,000 filaments/cm$^2$. The guard hairs are in most case not crimped or lowly crimped and the fineness is more than 5 d, particularly more than 10 d, more particularly 15–100 d, and the density is 50–5,000 filaments/cm$^2$, preferably 100–1,000 filaments/cm$^2$. In the piles of natural furs, the top portion is fine and sharp, the middle portion has a larger fineness and the root portion is fine and in the artificial pile articles, such a structure is preferable. FIG. 1 shows such guard hairs wherein the top portion is sharp, the middle portion has a larger fineness and the root portion is fine. In the drawings, in order to show the colored state understandably, the fineness of the guard hairs is illustrated in an enlarged state.

FIG. 1 shows a case of the guard hairs 3*a* wherein the color is suddenly varied substantially at the given distance from the substrate fabric 1, that is at a surface AA'. That is, the upper portion than the surface AA', namely the top portion of the guard hairs is colored white and the lower portion than the surface AA', that is the middle portion and the root portion of the guard hairs are colored black.

The surface AA' (parallel surface) having substantially constant distance from the substrate fabric is referred to as "level surface" and it is referred to as "level coloration" that the color of the piles at this level surface is varied to such an extent that the color can be judged by naked eyes. One preferable pile article of the present invention is characterized in that a part or all part of piles (cut piles or loop piles) are colored with the "level coloration".

The term "sudden color variation" used herein means that the color is substantially varied (varied to different hue, chroma or lightness) within a distance of less than 4 mm, preferably less than 3 mm along the length direction of the pile. When the length of the varied portion exceeds 4 mm, particularly exceeds 5 mm, the color variation is not recognized to be "sudden variation" but is recognized to be "gradational coloration". The products having the sudden color variation shows a different effect in appearance from the products having the gradational coloration, that is, shows the clear color variation, the high contrast.

FIG. 2 is a schematic view showing another embodiment of the pile articles of the present invention. In FIG. 2, two kind of guard hairs 3*b* and 3*c* are used. In the guard hairs 3*b*, the upper portion higher than the level surface AA' is colored black, the portion between the level surface AA' and the level surface BB' is colored white and the lower portion lower than the level surface BB' is colored black, and in the guard hairs 3*c*, the upper portion higher than the level surface CC' is colored black and the lower root portion than the level surface CC' is colored white. By varying the two-dimensional distribution of the guard hairs 3*b* and 3*c*, a variety of complicated and high grade appearances are provided to the pile articles.

FIG. 3 is a schematic view showing a further embodiment of the pile articles of the present invention. The pile article in FIG. 3 consists of two kinds of guard hairs 3*d* and 3*e* having different colored states. The guard hairs 3*d* are different in the color at the upper portion and the lower portion of the level surface EE' and the guard hairs 3*e* are varied in the color in multistage at the upper portion and the lower portion of the level surfaces AA', BB', CC' and DD'. In the piles wherein the color is varied in multistage within a relatively short distance as in the guard hairs 3*b* in FIG. 2 and the guard hairs 3*e* in FIG. 3, unless the color variation is effected particularly suddenly and distinctly, the effect in the appearance (sprinkly colored pattern, grandrelle pattern, etc.) cannot be obtained or only a low effect is obtained.

FIG. 1 to FIG. 3 show the embodiments wherein the combination of the color variation is white and black but the present invention can be applied to any color. The present invention can be applied to not only the products having different lightness or chroma but also the products having different hue. Such color variation can be obtained by a large number of means, such as variation of an amount of a dyestuff adsorbed through a level dyeing method mentioned hereinafter, variation of the kind of dyestuff, decoloration, previous coloration of the fibers to be used or combination of these means.

The level colored piles give unique appearance to the products. For example, the piles as shown by 3*a* in FIG. 1 wherein the top portion or the upper portion is white (or light color) give the high grade of impression similar tto natural furs. Reversely, the piles wherein the root portion is white (or light color) and the top portion or the upper portion is black (or deep color) also, have the similar effect. The piles having a plurality of level surfaces as shown by 3*b* in FIG. 2 and 3*e* in FIG. 3, can give unique appearances, for example, sprinkly colored pattern, grandrelle pattern, Moire pattern and other high grade appearances and impressions to the products. By using the combination of the level colored piles with difference level colored piles or non-level colored piles, particularly by deviating and ununiformizing the two-dimensional distribution of at least one kind of level colored piles recording to a design, a high grade of products can be obtained. When the level colored piles are mixed with the non-level colored piles, if a ratio of the level colored piles is too small, the effect is lost. In order to obtain the satisfactory effect, it is desirable that the level colored piles are more than 10%, preferably more than 20%, more preferably more than 30% in the same kind of piles (for example, guard hairs, wools) having substantially the same fineness and length.

In the products of the present invention, the same kind of piles have substantially uniform colored state over a broad area (preferably whole surface) of the products, but of course, some irregularity and unevenness are permitted. For example, the center point of the color variation of the individual pile may be somewhat uneven in the distance from the level surface. That is, the level surface is an average surface of the central point of the color variation of the individual pile. This unevenness is permitted to be less than 15%, preferably less than 10% in the standard deviation ($\sigma$), or less than 2 mm, preferably less than 1 mm.

Then, an explanation will be made with respect to the products having gradationally colored piles.

Figure 4:
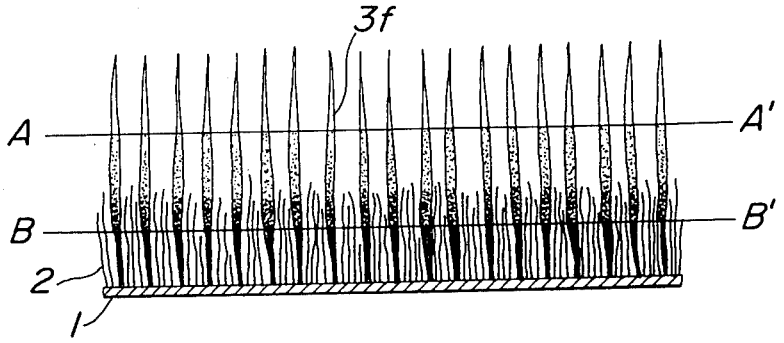
Figure 5:
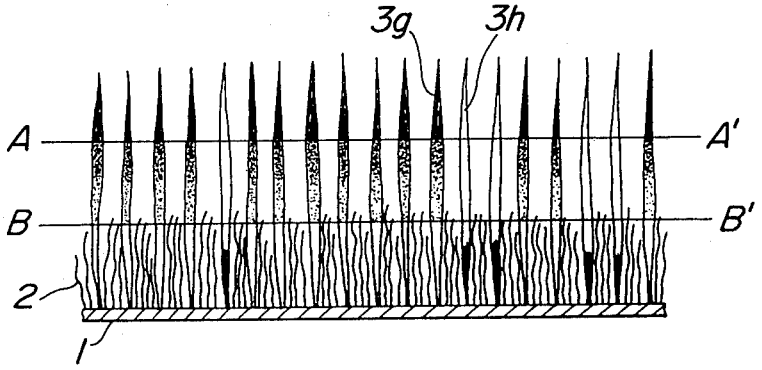
Figure 6:
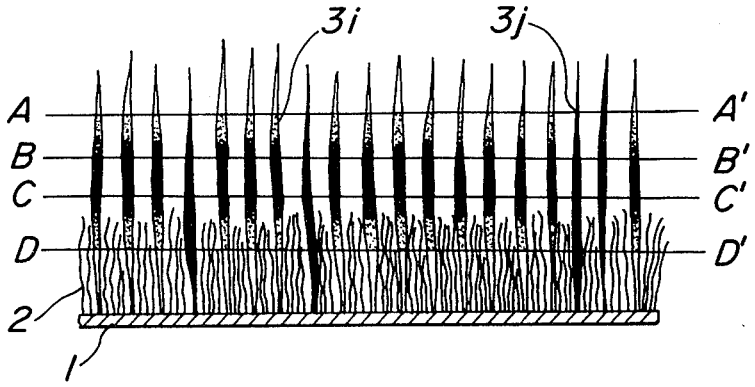

FIG. 4 to FIG. 6 are schematic views showing embodiments of the products of the present invention having gradationally colored piles.

FIG. 4 shows an embodiment of the pile article in which the top portion of the piles 3*f* is light color, the root portion is deep color and the middle portion had gradational coloration where the colored degree is gradually increased from the level surface AA' toward the level surface BB'. In FIG. 4, the surface AA' is the starting point of the color variation and the surface BB' is the finishing point of the variation. (Of course, the surface BB' and the surface AA' may be the starting point and the finishing point respectively). The gradation breadth is the distance between the surface AA' and the surface BB'. The color variation between the surface AA' and the surface BB' is the variation having gradient (for example, gradient of concentration of a dyestuff) and this gradient may be freely selected depending upon the object. For example, the gradient may be linear, stepwise, zigzag and other irregular but the variation increases or decreases as a whole from the starting point to the finishing point.

The starting point and the finishing point of the color variation must be substantially uniform (constant). For example, in FIG. 4 the starting point of the color variation of the individual pile is somewhat uneven but lies substantially on the level surface AA' and the finishing point lies substantially on the level surface BB' and the center point of the variation lies on an intermediate level surface of the surface AA' and the surface BB'. If the starting and the finishing are irregular and the unevenness is too large, the gradation effect is not obtained and a dirty contaminated impression is given. In order to give the uniform and high grade of appearance, for example, the unevenness is preferred to be less than ±30% of the distance (average distance) from the substrate fabric, preferably less than ±20%, more particularly less than ±10%. Similarly, this unevenness is preferred to be less than ±5 mm, preferably less than ±3 mm, more particularly less than ±2 mm.

The colors at the starting point and the finishing point of the color variation, namely at both ends of the gradationally colored portion, of course, have different colors. Unless the difference of color tone has such an extent that it can be distinguished through observation by naked eye, the gradating effect cannot be recognized. The difference of the color tone is satisfied, if the difference of the lightnessis more than 1, the difference of the chroma is more than 2 or the difference of the hue is more than 2.5 in Munsell indication. In particular, if there is the difference in lightness of 2–8, chroma of 4–10 or hue of more than 5, the colors at both the ends of the gradationally colored portion can be distinctly judged and the gradating effect becomes clear.

The color variation at the gradationally colored portion is obtained by effecting the dyeing or decoloring in gradient along the pile length by the method mentioned hereinafter. Therefore, it is most easy to vary an amount of a dyestuff adsorbed in gradient. When the amount of a dyestuff adsorbed varies, the lightness and the chroma vary and the most usual gradation is obtained. In order to vary the hue, it is necessary to vary the kind of dyestuff and a complicated operation is necessary, but the obtained products show a very complicated, that is, iridescent appearance and it is possible to obtain the products having high designing ability or fashionability which is not possessed by natural furs. Of course, two or more among the group of lightness, hue and chroma may be concurrently varied.

The distance (gradation breadth) between the starting point and the finishing point of the color variation must be more than 4 mm, preferably 5–60 mm. When the breadth of the gradiationally colored portion is small, the gradating effect of which is the gradual variation of color tone, is not obtained and such a variation is recognized to be the sudden variation of color. This breadth of gradation is preferred to be more than 20% of the pile length, particularly more than 50%, because such a breadth gives the effect of soft color.

In the present invention, the gradational coloration is applied to either or both of the guard hairs and the wools. FIG. 4 to FIG. 6 show the embodiments wherein the guard hairs 3*f*, 3*g* and 3*i* are gradationally colored. The color of the wools 2 is not shown in the drawings but they may be gradationally colored.

The products of the present invention include those having plural kinds of piles having different colors. FIG. 4 is an embodiment wherein every guard hair 3*f* is gradationally colored.

FIG. 5 is an embodiment wherein a part of guard hairs 3*g* is gradationally colored and another part of guard hairs 3*h* is not gradationally colored. That is, the guard hairs 3*g* are colored deeply at the top portion, colored lightly at the root portion and colored gradationally at the middle portion. The starting point of the gradation is the level surface AA' and the finishing point is the level surface BB'. While, the guard hairs 3*h* are colored lightly at the top and middle portions, and colored deeply at the root portion. Similarly, in FIG. 6, the guard hairs 3*i* are deeply colored at the middle portion and lightly colored at the top portion and the root portion, and both the portions between the surface AA' and the surface BB', and between the surface CC' and the surface DD' at the middle portion are gradationally colored. The guard hairs 3*j* are wholly deeply colored. The products having two or more kinds of piles wherein the colored state of the guard hairs is different as shown in FIG. 6, are produced by using two or more kinds of fibers having different dyeability or decoloring ability. For example, the fibers having different adsorbability with respect to a common dyestuff or the fibers having different adsorbability with respect to different dyestuffs may be used in combination. For example, the fiber which adsorbs an acidic dyestuff but does not adsorb a basic dyestuff and the fiber which adsorbs a basic dyestuff but does not adsorb an acidic dyestuff may be combined. By skillfully combining the thus obtained piles having two or more different colored states, complicated and high grade of products can be obtained. Furthermore, by arranging regularly or irregularly two or more kinds of piles having different colors two-dimensionally on a substrate fabric, natural fur-like or more high grade of appearance can be obtained.

FIG. 4 to FIG. 6 show the embodiments wherein the gradationally colored piles are only one kind but the products having two or more kinds of gradationally colored piles show the excellent appearance and are useful.

In order that the gradating effect is apparently recognized, it is desirable that concerning the guard hairs or wools, more than 10%, preferably more than 20%, more particularly more than 30% of the piles is gradationally colored. In the product where the wools and the guard hairs are not distinguished, it may be considered that all piles are guard hairs (or wools). Similarly, concerning loop pile articles, it is preferable that more than 10%, particularly more than 20%, more particularly more than 30% of piles are gradationally colored.

FIG. 1 to FIG. 6 show the embodiments wherein the piles straightly stand up but the products of the present invention include the pile articles wherein the piles incline, fall down or curve. In such products, the piles are straightly stood by a proper means (for example, heat treating by utilizing centrifugal force mentioned hereinafter) and then the level surfaces where the color is suddenly varied or the color variation starts or finishes when the color is gradually varied, are determined.

As seen from the above described explanation, the present invention can provide novel products entirely different from prior products and provided with piles having very high grade and unique colored state. If necessary, the pile articles similar to high grade of natural furs, the production of which has been heretofore impossible or very difficult, or unique pile articles conforming to free design, which has never been present in natural furs, can be easily obtained and the scope of application of the present invention is very broad. For example, the products having the piles wherein the color is suddenly varied can provide pile articles similar to natural furs, such as fox, raccoon, dog, squirrel, chinchilla, beaver and the like, and the high grade of pile articles having grandrelle pattern, Moire pattern and other fashionable designs. The products having the gradationally colored piles can provide the pile articles wherein the color is delicately and softly gradated, for examle, mink, some kinds of foxes.

The inventors have made study with respect to the method for precisely producing the pile articles and found the methods for easily producing the pile articles having the above described sudden color variation or the pile articles having the gradational coloration.

An explanation will be made with respect to these methods hereinafter.

One of the great problems when the coloration or fineness (diameter) of piles is varied in the length direction of the pile is that the piles are kept in the raised state and the raised piles are subjected to any process in high precision. The inventors have made diligent study with respect to this point and found that the piles are kept under raised state by centrifugal force and a surface (interface) of a treating liquid (for example, dyeing solution, decoloring solution, solvent, a solution of a decomposing agent, etc.) is formed and a contacting state of said liquid surface (interface) with the piles is controlled, whereby the colored state or fineness (diameter) of the piles is freely varied, and the present invention has been accomplished.

The method of the present invention comprises rotating a fibrous structure having piles fixed on a rotating body to raise the piles owing to the centrifugal force of said rotation and forming a cylindrical interface of a treating liquid retained in a rotary container, whereby the raised piles are contacted with the treating liquid forming the interface.

The term "piles" used in the present invention means cut piles, loop piles, raised piles and other piles. The term "fibrous structure' means knitted fabric, woven fabric, non-woven fabric and the like.

The method of the present invention is suitable for the production of the structures shown in FIG. 1 to FIG. 6 but is not limited to the structures shown in these drawings. That is, the present invention is not limited to the pile articles consisting of two kinds of piles of guard hairs and wools and can be applied to, for example, ones consisting of only one kind of piles or ones consisting of three or more kinds of piles. Similarly, the present invention can be applied to the production of the products in which the fineness of the piles is varied along the length direction and in which the fineness is not varied and only the color is varied. In addition, the piles may be cut at a uniform length, the piles may be partially swelled or crimps may be developed in latent crimpable yarns. The present invention, can be similarly applied to both the crimped piles and the non-crimped piles.

Figure 7:
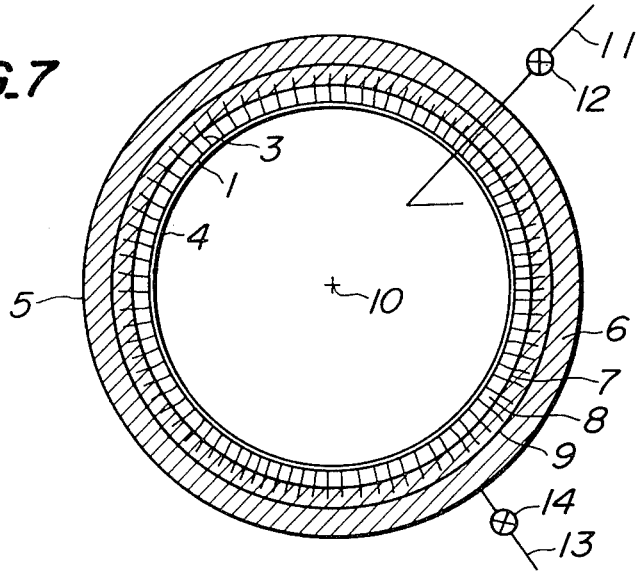
FIG. 7 is a schematic cross-sectional view of an apparatus for producing a pile article showing one embodiment for carrying out a method of the present invention.
Figure 8:
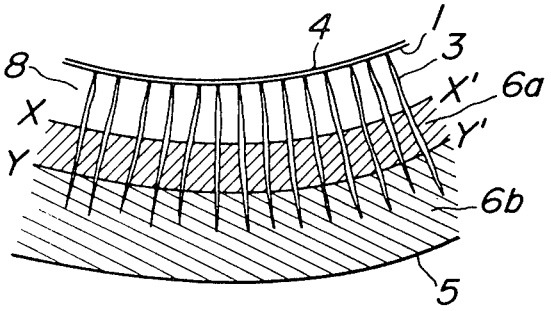
FIG. 8 is a partial schematic view of the apparatus shown in FIG. 7 illustrating another method for carrying out the present invention.
Figure 9:
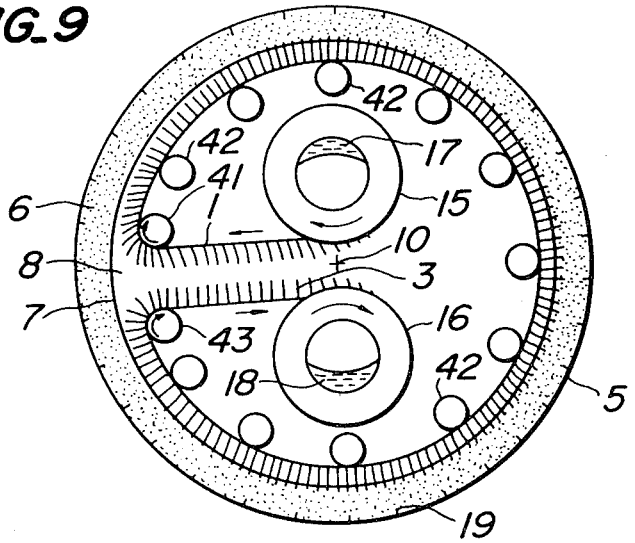
FIG. 9 is a schematic cross-sectional view of another apparatus for illustrating a further method for carrying out the present invention.

FIG. 7 to FIG. 9 are schematic views (cross-sectional views) showing apparatuses for carrying out the methods of the present invention. In FIG. 7, a substrate fabric 1 having the piles 3 is fixed to an inner cylinder 4 and rotated around a center 10 of a rotary axis. An outer cylinder 5 is rotated at the same angular velocity and a treating liquid 6 forms a liquid surface 7 owing to centrifugal force. 8 is a space. The treating liquid is fed from a feeding portion 11 and discharged from a discharging portion 13. The liquid surface 7 of the treating liquid can be freely controlled by a feeding valve 12 or a discharging valve 14 and a desired portion of the piles can be treated. When the treating liquid is a dyeing solution or a decoloring solution, if the liquid surface 7 is kept at a predetermined position for a predetermined time, the liquid surface 7 corresponds to the color variation surface (level surface) in the case of the sudden color variation. It is apparent that the color variation surface can be set at any position by the method shown in FIG. 7. In this method, it is very easy to stretch the piles strongly outwardly owing to centrifugal force and to raise the piles uniformly. In addition, a dyeing solution is strongly pulled outwardly by centrifugal force, so that it is possible to prevent the penetration of the dyeing solution into the space 8 and a non-contaminated uniform product can be obtained.

When the top portion of the piles is decolored by the method of FIG. 7, the product as shown in FIG. 1 is obtained. When the upper half of the piles is decolored and then the top portion is dyed, the piles as shown by 3*b* in FIG. 2 are obtained. If only the top portion is dyed, the product wherein only the top portion is colored and which is reverse to FIG. 1, is obtained. Thus, by retaining the surface of the treating liquid at a predetermined position for a predetermined time and effecting the dyeing and/or decoloring, the products as shown in FIG. 1 to FIG. 3 and numerous similar products having the piles wherein the color is suddenly varied along the level surface can be obtained.

In the method shown in FIG. 7, when a dyeing solution is firstly filled to a surface 9 and then the liquid surface is elevated to a surface 7 by gradually feeding the dyeing solution from a valve 12, the top portion of the piles 3 is deeply dyed and the portion from the top to the middle is gradationally colored. In this manner, by retaining the dyeing solution at a certain position (starting point of the gradiation) to effect the dyeing and then supplementing or discharging the solution to gradually move the liquid surface to reach said surface to another position (finishing point of the gradation), the gradational coloration can be attained. In this method, the amount of the dyestuff adsorbed is gradually varied at the gradated portion and the lightness and the chroma are varied.

When the dyeing is effected while varying the concentration and kind of the dyestuff in the dyeing solution through operation of the valves 12 and 14, more complicated and high grade of gradational dyeing wherein the hue and chroma are varied, can be effected.

The gradational coloration can be effected by decoloring the already dyed piles in gradient by using a decoloring solution, that is a solution containing a bleaching agent, which decomposes or chemically changes a dyestuff, or a dyestuff extracting solvent instead of a dyestuff and moving the treating liquid surface.

The product as shown in FIG. 4 can be obtained by decoloring the already dyed guard hairs while moving the treating liquid surface from the surface AA' to the surface BB'. Of course, it is possible to move the treating liquid surface from the surface BB' to the surface AA' or the treating liquid surface may be reciprocated between both the liquid surfaces AA' and BB'. The guard hairs as shown by 3*g* in FIG. 5 can be obtained by effecting the dyeing while moving the liquid surface of a dyeing solution from the surface AA' to the surface BB'. By dyeing and/or decoloring the piles while moving the treating liquid surface, the products as shown in FIG. 4 to FIG. 6 and numerous products having the similar gradationally colored piles can be obtained.

FIG. 8 is a partial cross-sectional view of an apparatus for carrying out another method of the present invention wherein the piles raised owing to centrifugal force are treated. In FIG. 8, the inner cylinder 4 and the outer cylinder 5 are rotated in the same manner as in FIG. 7 and the centrifugal force is applied to the piles 3. The substrate fabric 1 is held on the inner cylinder 4 and two kinds of liquids 6*a* and 6*b* are held and rotated with the outer cylinder 5. The liquid 6*b* is higher than the liquid 6*a* in the density and both the liquids are not mixed or dissolved with each other. The liquid surface XX' can be varied by increasing or decreasing the liquid 6*a* but similarly may be varied by increasing or decreasing the liquid 6*b*. The liquid surface YY' may be varied by increasing or decreasing the liquid 6*b*. In any case, by using a dyeing solution or a decoloring solution as the liquid 6*a* and increasing or decreasing the liquid 6*b* or/and the liquid 6*a* to control the positions of the liquid surfaces XX' and YY' and to gradually move these liquid surfaces, the piles 3 can be dyed or decolored in gradient from the desired position to the desired position. In this manner, the starting point and the finishing point of the gradation, and the gradient (rate of variation) of the gradation can be desirably and uniformly controlled.

If the dyeing is effected by using 6*a* as a dyeing solution and 6*b* as an inactive liquid and constantly holding the positions of the liquid surfaces XX' and YY', the product wherein the middle portion of the piles is dyed. If this operation is repeated by varying the positions of the liquid surfaces XX' and YY', piles dyed in multistage as shown by 3*e* in FIG. 3 are obtained. When a decoloring solution is used as the treating liquid 6*a* and an inactive liquid is used as the treating liquid 6*b*, the product having guard hairs as shown by 3*b* in FIG. 2 is obtained. The liquid surfaces XX' and YY' apparently correspond to the level surfaces.

FIG. 9 is a schematic cross-sectional view of an apparatus for carrying out a further method of the present invention. FIG. 9 shows a method wherein the state where the piles are contacted with the treating liquid, is varied together with time by moving the piles, even though the treating liquid surface is kept at a constant position. In this method, the pile article is semi-continuously treated.

In FIG. 9, the structure consisting of the piles 3 and the substrate fabric 1 is fed from a spool 15 through a feeding roll 41, moved along eleven guide rolls 42, taken out through a roll 43 and wound on a spool 16. The holding device consisting of these rolls and spools is rotated about an axis 10 to apply centrifugal force to the piles and to raise the piles in the radial direction. The outer cylinder 5 is filled with a treating liquid 6 and rotated about an axis 10 and an interface 7 is formed between the treating liquid 6 and a space 8 owing to the centrifugal force. Eleven guide rolls 42 are arranged in an eccentric relation to the central axis 10, so that as the substrate fabric is moved along the guide rolls 42, the state where the piles are contacted with the treating liquid, is varied. Namely, the pile article is not contacted with the treating liquid when said article is fed from the feeding roll 41, but as the pile article is moved toward the right direction, said article comes in contact with the treating liquid and at the right end, the pile article contacts with the treating liquid in the maximum depth. Then, as the pile article returns to the left direction, the contacting depth becomes smaller and near the taking out roll 43, the pile article does not contact with the treating liquid. By prolonging the contacting time of the top portion of the piles in this manner, it is possible to deeply dye or highly decolor the top portion of the piles or highly decompose or dissolve said portion to make the diameter of said portion smaller. In the method of FIG. 9, a fairly long pile article can be treated by using a large feeding spool 15 and a large winding up spool 16. In oder to prevent that as the pile article is moved from the feeding spool 15 to the winding up spool 16, the center of gravity of the holding device moves and the rotation balance is disturbed, it is preferble to increase or decrease the compensating (balancing) liquids 17 and 18 respectively. The amounts of the compensating liquids 17 and 18 may be automatically controlled by providing a device for detecting the balance of rotation. 19 is fins for efficiently transmitting the rotation of the outer cylinder 5 to the liquid.

The method of the present invention can apply to all pile articles as mentioned above. For example, the present invention can be applied to dyeing, decoloring, cutting, varying of the fineness, swelling, dissolving, decomposing, adsorbing, shrinking, crimp developing and other various processings of piles in pile articles having short piles, such as velveteen, velvet, suede and the like, fur-like pile articles having long piles, and pile articles having loop piles, such as towels.

Explanation has been made with respect to the case where a dyeing solution or a decoloring solution is used as the treating liquid. A further explanation will be made hereinafter with respect to the process wherein the other treating liquids are used.

By partially dissolving or decomposing and removing the piles by using a solvent or a solution containing a decomposing agent as the treating liquid, the fineness of the piles can be varied or the piles can be cut. As the solvent, ones which can gradually dissolve the fibers from the surface without excessively swelling, are desirable. As the decomposing agent, an aqueous solution of a strong alkali, such as sodium hydroxide is well-known for polyester fibers and in this case the fibers are gradually decomposed and removed from the surface without substantially swelling, so that this agent is preferable. For example, in FIG. 7, when a polyester fiber (polyethylene terephthalate, polybutylene terephthalate, polyethyleneoxybenzoate, etc.) is used for the piles 3, an aqueous solution (1–30%) of sodium hydroxide heated at 60°–100° C. is used as the treating liquid and the interface of the treating liquid is gradually moved from the position 9 to the position 7, the fineness of the piles is gradually decreased from the middle portion to the top portion. In FIG. 8, when a liquid (for example, a mixture of carbon tetrachloride and a liquid paraffin) which is inactive to the piles, has no compatibility to the treating liquid and has a higher specific gravity than the treating liquid and a lower specific gravity than the piles, is used as the liquid *6b* and an aqueous solution of an alkali is used as the treating liquid *6a* and the treatment is effected at a proper temperature for a proper time, the middle portion of the piles can be decreased in the fineness. By decreasing the fineness of the root portion in the same manner, the touch of the piles can be improved. The root portion, the middle portion and the top portion of the piles can be freely decreased in the fineness in this manner.

FIG. 1 to FIG. 6 are the embodiments wherein the top portion of the piles is made fine in this manner. If the piles are dissolved or decomposed by continuously moving the treating liquid surface, the fineness of the piles is continuously decreased and if the liquid surface is moved stepwise, the fineness of the piles is stepwise decreased. When the liquid surface is kept at a given position and the dissolution or the decomposition is effected, the piles can be cut. Similarly, when one component of composite filaments composed of a plurality of components is dissolved or decomposed and removed, the piles can be separated into a plurality of fibrils or partially made fine. As such composite filaments, mention may be made of the composite filaments wherein two components having different solubility or separatability are bonded in side-by-side or sheath-core relation or in a radial multilayer structure.

When a swelling agent is used as a treating liquid, a part or the whole of piles can be shrunk and similarly crimps of the piles having a latent crimpability (self-crimpability) can be developed. Similarly, by swelling one component of fibril-forming composite filaments, the piles can be fibrillated.

When a heated water or liquid is used as the treating liquid, the piles can be heat treated at a desired portion or in the whole. For example, when the raised piles are heated and then cooled, the piles are heat-set in the uniformly raised state. Similarly, the piles may be shrunk or crimps may be developed by a heat treatment. The heat treatment can be effected by using a gas instead of a liquid but the gas cannot effect the partial heat treatment, for example, it is impossible to effect the heat treatment only at the top portion of the piles.

In order to raise the piles in a liquid by the centrifugal force, it is desirable that the density of the treating liquid is lower than that of the piles. The density of most fibers is more than 1 and water and large number of organic compound liquids are utilized as the treating liquid. For example, the density of nylon-6 and nylon-66 is about 1.14, the density of acrylic fibers is about 1.14–1.28 and the density of polyethylene terephthalate is about 1.38.

The centrifugal force applied in the present invention must have an enough power to raise the piles and form a cylindrical liquid surface (interface) in the treating liquid and is generally more than 3 times (3 G) of the gravity acceleration G, in many cases more than 5 times (5 G), preferably more than 10 times (10 G) and particularly more than 30 times (30 G). As the acceleration due to the centrifugal force is larger (particularly more than 100 G), the raising ability of the piles is higher but the centrifugal force is limited to less than 10,000 G in practice in view of the mechanical strength. For example, when the radius is 1 m and the rotating speed is 1 rotation per 1 second, the centrifugal force is about 4 G but the raising ability of the piles and the cyliner-forming ability of the liquid surface of the treating liquid are somewhat low. When the rotating speed is 10 rotations per 1 second, the centrifugal acceleration is about 400 G and is satisfactory. In the crimped piles, when the acceleration is too large, there is fear that the crimps are elongated, so that it is necessary to select the proper acceleration.

The direction of the rotary shaft 10 may be horizontal, perpendicular or any other angle. In order to control the liquid surface, an inlet, an outlet, a pump, valves, a liquid level detector for a treating liquid may be provided. Of course, a heating or cooling device, or temperature detecting device for controlling the temperature of the treating liquid may be provided. In the case of the apparatus as shown in FIG. 9, there are apparently various applications with respect to the arrangement of the guide rolls 42. For example, the state (depth) where the treating liquid is contacted with the piles may be varied in sine, linear, quadratic or any other time function.

The rotary angle velocity of the holding portion of the piles and the treating liquid may be equal or more or less different. The equal case is advantageous, because the rotary axis and the driving system can be used together. When the rotary angle velocity is different, the treating liquid is stirred and the more uniform treatment is feasible. When the velocity difference is too high (for example, more than 1 rotation/sec.), the raising of the piles is disturbed and such a case is not preferable. Furthermore, in order to keep the uniformity of the treating liquid, it is possible to provide a pump in the system of the treating liquid and circulate the liquid.

As the fibers for composing the piles, use may be made of natural fibers, chemical fibers, synthetic fibers and other fibers. The fibers for composing the piles may be a mixture of two or more kinds of fibers. For example, by applying the method of the present invention to pile articles consisting of two or more fibers having different fineness, cross-sectional shape, dyeability, decoloring ability, decomposing ability, solubility, shrinkability, crimpability, latent crimpability, self separating ability and the like, for example, Jacquard knitted or woven fabrics, the products having complicated color, appearance and feeling can be produced.

In the method of the present invention, the interface of the treating liquid can be controlled in high precision and the treatment varied depending upon the portion of the piles can be precisely carried out. In a prior method, for example, in the method wherein as shown in FIG. 1 in Japanese Patent Application Publication No. 4,910/73, a treating liquid is filled in a vessel, piles are suspended from the upper portion (by gravity) and the top portion of the piles is immersed in the treating liquid, the treating liquid is sucked up between pile owing to capillary phenomenon and the undesired position which is not to be treated, is irregularly treated or contaminated and this is a great defect. In the method of the present invention, the penetration of the treating liquid into the unnecessary portions due to the capillary phenomenon can be prevented by using the centrifugal force, for example, more than 10 G, particularly more than 30 G. In general, the piles in many cases, may be crimped, curled, irregularly inclined, fallen down, irregularly entangled or bundled and it is difficult to uniformly raise the piles. Accordingly, it has been heretofore difficult to apply a uniform treatment to the piles in the prior arts but the present invention can raise the piles owing to the centrifugal force by the force of several times, if necessary several tens times, several hundreds times of gravity, so that the uniformity of the treatment is surprisingly improved.

The above described products having high grade and precise color have been firstly produced by the method of the present invention.

The following examples are given for the purpose of illustration of this invention and are not intended as limitations thereof.

EXAMPLE 1

A polymer obtained by copolymerizing 92% by weight (hereinafter, % means by weight) of acrylonitrile, 7% of methyl acrylate and 1% of sodium acrylsulfonate was referred to as polymer P-1,and a polymer obtained by copolymerizing 89% of acrylonitrile, 10% of methyl acrylate and 1% of sodium allylsulfonate was referred to as polymer P-2. The polymers P-1 and P-2 were dissolved in dimethylformamide (DMF) respectively, and subjected to a wet conjugate spinning by using a water/DMF mixture as a coagulation bath in a side-by-side relation and in a conjugate ratio of 1/1. The spun filaments were drawn to 8 times their original length in water kept at 100° C., and then shrunk by 15% in water kept at 100° C. The shrunk filaments were dried in air kept at 120° C. to obtain acrylic composite filaments F-1 (120 d/100 f) having a latent crimpability.

A cut pile woven fabric CP-1 having a cut pile length of 18 mm and a pile density of about 10,000 filaments/cm$^2$ was formed by using the filaments F-1 as a pile yarn and nylon-6 filaments F-2 (150 d/40 f) as a ground yarn.

A polyester obtained by copolymerizing 95% of ethylene terephthalate and 5% of polyethylene glycol having a molecular weight of 600 was referred to as polymer P-3. The polymer P-3 (containing 0.6% of titanium oxide) was melt spun, and the spun filaments were drawn to 3.5 times their original length at 100° C. and then heat treated at 145° C. to obtain filaments F-3 of 120 d/3 f.

The cut pile woven fabric CP-1 was flocked with the filaments F-3 in a pile density of about 400 filaments/cm$^2$ by a tufting method to obtain a cut pile woven fabric CP-2 having a cut pile length of 30 mm. The pile woven fabric CP-2 was a double-structured pile article wherein the piles consisting of the filaments F-1 correspond to wools and the piles consisting of the filaments F-3 correspond to guard hairs. However, the guard hairs were coarse and rigid and were poor in the appearance and feeling.

In order to eliminate these drawbacks, the root portion and top portion of the guard hairs of the pile woven fabric CP-2 were decreased in the fineness (pile diameter) in a method illustrated in FIG. 8. This process will be explained hereinafter in detail.

The pile woven fabric CP-2 was fixed to an inner cylindr 4 having a diameter of 1 m, and was rotated at a rate of 600 revolutions/min together with an outer cylinder having a diameter of 1.2 m to raise piles by the centrifugal force. Then, a mixture of carbon tetrachloride and liquid paraffin and having a specific gravity of 1.2 was charged into the outer cylinder up to a position, where a distance of the surface of the mixture from the substrate fabric 1 was 15 mm, and then an aqueous solution containing 6% of sodium hydroxide and 0.5% of an alkali hydrolysis promotor (DYK-1125, made by Ipposha Oil and Fat Co.) was charged in the outer cylinder up to a position, where a distance of the surface of the aqueous solution from the substrate fabric was 2 mm. That is, in FIG. 8, liquid 6*a* is the aqueous alkali solution, and liquid 6*b* is the mixture of carbon tetrachloride/liquid paraffin; and the position of a surface XX' from the substrate fabric 1 is 2 mm, and that of the surface YY' from the substrate fabric 1 is 15 mm. The pile woven fabric CP-2 was treated with the aqueous alkali solution at 70° C. for 90 minutes at the above described position to dissolve partly the root portion of the guard hairs and to decrease the fineness thereof to substantially ½ (by weight). Then, the mixture of carbon tetrachloride/liquid paraffin was removed, and the same aqueous alkali solution as described above was charged into the outer cylinder so that the distance of the surface of the aqueous alkali solution from the substrate fabric became 30 mm, and further the aqueous alkali solution was gradually added to raise the liquid surfac up to a position 20 mm distant from the substrate fabric in 90 minutes. Then, the aqueous alkali solution was gradually removed to lower the surface to a position 30 mm distant from the substrate fabric in 90 minutes. Then, the aqueous alkali solution was wholly removed, and the above treated pile woven fabric was thoroughly washed with water to obtain a pile woven fabric CP-3 having guard hairs (consisting of filaments F-3) having the root portion and the top portion having the decreased fineness.

Then, the guard hairs of the pile woven fabric CP-3 was subjected to the level coloration to obtain a pile fabric as shown in FIG. 1. The CP-3 was firstly treated with an aqueous solution of a grey basic dyestuff (Bayer Japan Co., Astrazon Grey BL) at 100° C. for 30 minutes to dye the acrylic piles (wools) in grey color (0.5% owf). Subsequently, the above treated CP-3 was subjected to a dyeing treatment at 98° C. according to the method shown in FIG. 8, wherein a mixture (density: 1.3) of tetrachloroethylene/liquid paraffin was used as the liquid *6b* and an aqueous solution of black disperse dye (Kayalon Polyester Black T, made by Nippon Kayaku Co.) was used as the liquid *6a*. In this dyeing, the liquid surface XX' was set to the position of the substrate fabric and the liquid surface YY' was set to a position 20 mm distant from the substrate fabric, and the dyeing was effected for 45 minutes to dye the pile woven fabric CP-3 in a deeply black color (lightness: 1.5–2). After dyeing, the dyed fabric was washed with water and then dried. The back-side of the dyed fabric was impregnated with a polyurethane elastomer resin solution and then adhered with a thin suede-like cloth to obtain a fur-like product CP-4. The CP-4 has an appearance quite similar to the fur of silver fox and give a very high grade of impression. The top portion of about 10 mm in the guard hairs of the CP-4 had a very pale greyish white color (lightness: about 9–9.5). This grey color is due to a small amount of the black dyestuff dissolved out into the mixture of tetrachloroethylene/liquid paraffin, and gives a natural impression rather than the impression given by pure white color. In order to increase the whiteness at the top portion of the guard hairs, said portion (10 mm) of the piles was immersed in a dyestuff extracting agent, for example, dimethylformamide at 110° C. for 5–10 minutes in the method illustrated in FIG. 7. In order to more increase the whiteness, only the top portion of the piles may be contacted with a solution of fluorescent whitening agent.

EXAMPLE 2

By using the pile woven fabric CP-3 in Example 1, the guard hairs were subjected to a multistage of level coloration for obtaining the guard hairs *3e* shown in FIG. 3.

In the method illustrated in FIG. 8, as the liquids *6a* and *6b*, use were made of the same liquids as in Example 1. Firstly, the dyeing solution *6a* was fed in the outer cylinder 5 so that the position of the liquid surface XX' was set to contact with the substrate fabric 1 and the liquid surface YY' was set to be distant 5 mm from the substrate fabric and the dyeing was effected at 98° C. for 15 minutes. Then, the inactive liquid *6b* was gradually discharged and the dyeing was effected for 15 minutes at the positions where the liquid surface XX' was distant 5 mm and the liquid surface YY' was distant 10 mm from the substrate fabric. Then, the inactive liquid *6b* was further discharged so that the positions of the liquid surface XX' and the liquid surface YY' were set to be 15 mm and 20 mm from the substrate fabric respectively and the dyeing was effected for 15 minutes and then similarly the positions of the liquid surface XX' and the liquid surface YY' were set to be 25 mm and 30 mm from the substrate fabric respectively and the dyeing was effected to obtain a pile woven fabric CP-5.

In CP-5, the root portion of the hairs of about 10 mm was dyed in deep black (lightness: about 2), the succeeding portion of about 5 mm was dyed in white (lightness: 9.5), the succeeding portion of about 5 mm was dyed in white, the succeeding portion of about 5 mm was dyed in black, the succeeding portion of about 5 mm was dyed in white and the top of about 5 mm was dyed in black. The thus obtained pile woven fabric has a unique sprinkly colored appearance.

If filaments for hair were previously dyed in black and white, for example, in an interval of 5 mm by a printing method to produce a pile woven fabric of a product having a sprinkly colored pattern similar to CP-5. But, in this case, the colored state of the hairs is irregularly disturbed, for example, the white piles and the black piles at the top portion are randomly distributed and a dirty contaminated impression given and this comparative product does not give the high grade of impression as in CP-5 of the present invention.

EXAMPLE 3

The pile woven fabric CP-3 obtained in Example 1 was gradationally dyed.

Firstly, CP-3 was dyed with an aqueous solution of a grey basic dyestuff (Bayer Japan Co., Astrazon Grey BL) at 100° C. for 30 minutes and the piles (wools) of acrylic composite filaments were dyed in pale grey (amount of dyestuff adsorbed: 0.1% owf). Then, in the method shown in FIG. 8, by using a mixed liquid (density: 1.3) of tetrachloroethylene and liquid paraffin as the liquid *6b* and a black disperse dye (Nippon Kayaku Co., Kayalon Polyester Black T) as the liquid *6a*, the dyeing was effected at 98° C. The liquid surface XX' of the dyeing solution *6a* was set to coincide with the position of the substrate fabric and the liquid surface YY' of the tetrachloroethylene mixed liquid was set to be distant 10 mm from the substrate fabric and the dyeing was effected for 10 minutes. Then, the tetrachloroethylene mixed liquid was gradually discharged and the liquid surface YY' was moved to the position 20 mm distant from the substrate fabric 1 in 10 minutes and concurrently the dyeing solution was supplemented and the liquid surface XX' was maintained at the position of the substrate fabric. After dyeing, the thus treated fabric was washed with water to obtain a pile woven fabric CP-6. In the hairs in CP-6, the top portion (10 mm) was greyish white (lightness: about 8.5), the root portion (10 mm) was somewhat deep grey (lightness: about 4) and the middle portion from 10 mm (the starting point of the color variation) to 20 mm (the finishing point) distant from the substrate fabric, was gradually varied in the lightness from 4 to 8.5 and the beautiful gradational coloration as shown in FIG. 4 was obtained.

The top portion of CP-6 was dyed in a very pale color with a slight amount of the disperse dye dissolved out into the mixed liquid of tetrachloroethylene and liquid paraffin but when the pure white is required, only the top portion was immersed in DMF at 110° C. for 15 minutes to extract the disperse dye and to effect the decoloration, whereby the excellent whiteness is obtained.

The pile article of the gradationally dyed CP-6 has never been heretofore obtained. For example, if a pile article is produced by using the previously gradationally dyed fibers, the gradated state is irregularly disturbed and the uniform product as shown in FIG. 4 is not obtained and a mix-colored product is obtained. A product obtained by a printing method is inferior in the uniformity to the product in the present invention. Namely, the starting point and the finishing point of the degradation are nonuniform and in the degradation itself, the color variation does not smoothly move and the contaminated impression is given.

EXAMPLE 4

The hairs of the pile woven fabric CP-3 in Example 1 were gradationally dyed in the method illustrated in FIG. 7 so that the top portion of the hairs 3b was deeply colored and the root portion was dyed in a pale color.

That is, CP-3 was fixed to the inner cylinder having a diameter of 1 m and rotated at a rate of 600 rpm and the outer cylinder (diameter: 1.2 m) retaining a dyeing solution was rotated at the same rotary angle velocity as described above.

0.05% aqueous solution (98° C.) of a black dyestuff (Nippon Kayaku Co., Kayalon Polyester Black T) was charged in the outer cylinder to the position of 10 mm from the top of the hairs and the dyeing was effected for 10 minutes and then the dyeing solution was gradually supplemented from the valve 12 to elevate the liquid surface and reached the position 10 mm distant from the substrate fabric in 5 minutes and then the dyeing solution was gradually discharged from the valve 14 and reached the position 20 mm distant from the substrate fabric in 5 minutes, after which the dyeing was finished.

In the obtained pile woven fabric CP-7, the top portion (about 10 mm) of the hairs was dyed in black (lightness: about 1.5), the root portion (about 10 mm) was dyed in while (lightness about 9.0) and the middle portion (10 mm) was uniformly gradationally dyed and this product was very beautiful.

EXAMPLE 5

A polyester obtained by copolymerizing 3 mol % of ethylenesulfoisophthalate component (sodium salt) and 3% by weight of polyethylene glycol (molecular weight: 600) based on 100 parts by weight of ethylene terephthalate component is referred to as "P-4". P-4 was spun and drawn in the same manner as in the filament F-3 in Example 1 to obtain drawn filament (referred to as "F-4") of 120 deniers/3 filaments.

To the cut pile woven fabric CP-1 in Example 1 were tufted the filaments F-3 in Example 1 in a tufting method to flock piles in a pile length of 40 mm and a pile density of 300 filaments/cm$^2$ and the above described filaments F-4 were flocked in the density of 200 filaments/cm$^2$. The tufting was effected in such a manner that the filaments F-3 and the filaments F-4 were not uniformly mixed but in some portion, the pile number of F-4 is larger and in the other portion the pile number of F-3 is larger.

In the obtained cut pile CP-8, the wools consist of acrylic composite filaments F-1 and the pile length was 18 mm and the pile density was about 10,000 filaments/cm$^2$, and the guard hairs consist of two kinds of polyester filaments and the pile length was 40 mm and the pile density was about 500 filaments/cm$^2$. The pile woven fabric CP-8 was treated with an aqueous solution of an alkali in the same manner as in CP-3 in Example 3 and the root portion (10 mm) and the top portion (10 mm) were decreased in the fineness to obtain a pile fabric CP-9.

CP-9 was dyed in the method illustrated in FIG. 7. Namely, 0.05% of an aqueous solution (pH: 4.5) of a black basic dyestuff (Bayer Japan Co., Astrazon Black M) was fed into the outer cylinder so that 10 mm of the top portion of the guard hairs was immersed in said dyeing solution and the dyeing was effected at 98° C. for 10 minutes and then the dyeing solution was gradually supplemented and the liquid surface reached the substrate fabric in 5 minutes, after which the dyeing solution was discharged and the liquid surface was returned to the position 30 mm distant from the substrate fabric in 5 minutes and the dyeing was finished to obtain a pile woven fabric CP-10. In CP-10, the wools were gradationally dyed in pale color (lightness at the top portion: 6–7, the root portion: 8–9), and 10 mm at the top portion of the filaments F-4 in the guard hairs was black (lightness: 1–2) and the filaments F-4 was uniformly gradationally dyed from the middle portion to the root portion. The filaments F-3 were not substantially dyed and the lightness was 8–9. CP-10 had two kinds of guard hairs having different colored state and had a very complicated and high grade of silver fox-like appearance. In the production of CP-10, a variety of fur-like products having high grade can be obtained by varying the arrangement and mixed state of the two kinds of filaments F-3 and F-4 for the guard hairs.

In the same manner as in CP-10, if two or more kinds of dyestuffs, for example, a blue grey basic dyestuff and a black brown disperse dye are mixed, the very complicated color effect can be obtained.

The gradational coloration can be obtained by decoloring the once dyed piles in gradients. The decoloring means may be attained by contacting a solvent (for example, DMF) which extracts a dyestuff or a solution of a decomposing agent of a dyestuff through oxidation, reduction and the like, with the piles raised by the method in FIG. 7 or FIG. 8 by varying the contacting time in gradient.

In the pile articles of the present invention, a suitable resin, such as polyurethane elastomer, rubber latex, acrylic resin may be coated on the substrate fabric. Similarly, the pile articles may be lined with a woven fabric, a knitted fabric, a non-woven fabric or a sheet-like material, for example, a thin artificial leather-like material, after the substrate fabric is reinforced with a resin and the like.

EXAMPLE 6

The pile woven fabric CP-2 in Example 1 was fixed to an apparatus as shown in FIG. 7 wherein the shaft 10 is perpendicular, a diameter of the inner cylinder is 1 m and a diameter of the outer cylinder is 1.2 m, and subjected to a process for varying the fineness of the guard hairs. While the inner and outer cylinders were being rotated at a rate of 1,200 rpm, a mixture of carbon tetrachloride and liquid paraffin having a specific gravity of 1.2 was charged into the outer cylinder to a position 15 mm distant from the substrate fabric and then an aqueous solution containing 5% of sodium hydroxide and 0.5% of an alkali hydrolysis promotor (DYK-1125, made by Ipposha Oil and Fat Co.) was charged into the outer cylinder so that a thickness of said solution was 12 mm and the treatment was effected at 70° C. for 90 minutes. By this treatment, the guard hairs composed of the polyester filaments F-3 were decreased in the fineness of the root portion to about half (cross-sectional area). Then the mixed liquid of carbon tetrachloride and liquid paraffin was discharged out and the aqueous solution (70° C.) containing 5% of sodium hydroxide and 0.5% of hydrolysis promotor was gradually charged into the outer cylinder and the liquid surface of said solution was moved inwardly 10 mm in 90 minutes from the top end of the guard hairs, that is the point 30 mm distant from the substrate fabric, and then the alkali solution was gradually discharged out and the liquid surface of said solution was returned to the original position (30 mm distant from the substrate fabric) in 90 minutes and finally the alkali solution was completely discharged out. By this treatment with the alkali solution, the guard hairs composed of the polyester filaments F-3 were decreased in the fineness of the root portion extending about 12 mm and the portion extending 10 mm from the middle portion to the top portion was gradually decreased in the fineness. The structure of the obtained pile woven fabric was one as shown in FIG. 1 and similar to natural fur. This pile woven fabric is referred to as CP-11.

This pile woven fabric CP-11 was dyed by means of an apparatus shown in FIG. 9. Firstly, a dyeing solution containing a basic dyestuff was charged into the outer cylinder until the dyeing solution came in contact with the substrate fabric and the wools composed of the acrylic filaments F-1 were dyed at 90° C. for 60 minutes to obtain a very pale grey coloration (dyestuff owf 0.02%). Then, this dyeing solution was discharged out and a dyeing solution (95° C.) containing a disperse dye was charged into the outer cylinder to a point 30 mm distant from the substrate fabric (the top end of the guard hairs) and succeedingly the dyeing solution was gradually charged and reached the position of the substrate fabric in 60 minutes and the dyeing was stopped and the dyeing solution was discharged and thus dyed pile woven fabric was washed with water. The guard hairs composed of polyester filaments F-3 were colored in deep grey at the top portion and the root portion was colored in pale grey and an average ratio of dyestuff adsorbed was 0.1% owf. A back surface of the dyed pile woven fabric was coated with a polyurethane elastomer to fix the piles, which is referred as CP-12.

The pile woven fabric CP-12 had a very high grade of appearance and feeling similar to mink fur and was quite different from CP-2 which has not been processed or a product obtained by merely dyeing CP-2 in grey.

EXAMPLE 7

In substantially the same manner as in the pile woven fabric CP-12 in Example 6, by using filaments having 50 d/f and filaments having 30 d/f, both filaments being composed of the polymer P-1, in a ratio of 1:2 (ratio of filament number), the pile top portion extending 15 mm was gradually treated with the alkali solution for 120 minutes to obtain a pile woven fabric CP-13. In the pile woven fabric CP-13, the length of the guard hairs having the larger fineness (40 denier) was 30 mm but the length of the guard hairs having the smaller fineness (20 denier) was about 25 mm (5 mm at the top portion was completely decomposed) and this CP-13 had a more complicated and higher grade of appearance and feeling than CP-12.

EXAMPLE 8

A cut pile woven fabric CP-14 was obtained by using the filaments F-1 in Example 1 as the pile yarn and the filaments F-2 as the ground yarn. In CP-14, the pile length was 25 mm and the pile density was about 8,000 f/cm$^2$.

Polyester obtained by copolymerizing 5% by weight of polyethylene glycol having molecular weight of 600 and 3 mol % of ethylenesulfoisophthalate component based on polyethylene terephthalate, is referred to as P-5. The polymer P-5 was subjected to melt-spinning, hot-drawing and heat-treatment to obtain filaments F-5 having 40 d/f and in the same manner, filaments F-6 having 20 d/f were obtained. The polymer P-3 in Example 1 was subjected to melt-spinning, hot-drawing and heat-treatment to obtain filament F-7 having 30 d/f and filament F-8 having 20 d/f.

The filaments F-5, F-6, F-7 and F-8 were flocked on the pile woven fabric CP-14 in a density of 110 f/cm$^2$, respectively and the piles were cut at a length of 40 mm to obtain a pile woven fabric CP-15.

CP-15 was processed with an apparatus as shown in FIG. 9. Firstly, eleven guide rolls were adjusted (radius: 0.5 m) at a concentric position with respect to the central shaft and CP-15 was set and rotated at a rate of 1,200 rpm. The same mixed liquid of carbon tetrachloride and liquid paraffin (specific gravity of 1.2, 70° C.) as used in Example 6 was charged to the position 20 mm distant from the substrate fabric and the alkali solution (70° C.) used in Example 6 was charged in a thickness of 10 mm and the treatment was effected at 70° C. for 90 minutes to decrease the fineness of the root portion of the guard hairs (F-5, F-6, F-7 and F-8).

Then, the position of eleven guide rolls 42 was eccentrically arranged and adjusted. That is, the position of the eleven guide rolls 42 and the amount of the alkali solution charged were adjusted so that during 180 minutes when the fabric was delivered from the feed roll 41 to the taking up roll 43, the top end of the guard hairs always comes in contact with the alkali solution and the portion extending 10 mm from the top end of the guard hairs contacts with the alkali solution for 30 minutes and the contacting time of the portion extending 15 mm from the top end is 0, and the portion of 15 mm at the top end of the guard hairs was decreased in the fineness by the treatment with the alkali solution. After the treatment, the alkali solution was completely discharged out and then a dyeing solution containing weak acidic (pH: 4) black brown disperse dye (capable of being discharged with azo series substance) and black basic dyestuff was charged to the position of the substrate fabric and the dyeing was effected at 98° C. for 120 minutes. An amount of dyestuff adsorbed was about 5% (mainly basic dyestuff) in the acrylic wools, about 3% (mainly disperse dye) in the guard hairs composed of the polymer P-3 and about 6% (mainly basic dyestuff) in the guard hairs composed of the polymer P-5.

The dyeing solution was discharged and the dyestuff at the top portion of the guard hairs was extracted and decolored with DMF. That is, the amount of DMF charged and the position of the guide rolls were adjusted so that during 90 minutes when the pile woven fabric was moved on the eleven guide rolls 42, the top end of the guard hairs always contacted with DMF, the position 10 mm distant from the top end contacted with DMF for 15 minutes and the portion 15 mm distant from the top end did not contact.

The products obtained by being lined with an elastomer after decoloring and thoroughly washing had very excellent color, appearance and feeling and were similar to fox fur.

What is claimed is:

1. A method for producing a pile article comprising rotating a fibrous structure having piles, which structure is fixed on a rotating body, to raise the piles owing to centrifugal force caused by the rotation and contacting the raised piles with a treating liquid for fibers retained in a rotary container, said treating liquid forming a cylindrical interface due to the centrifugal force.

2. The method as claimed in claim 1, wherein the centrifugal force is more than 10 G.

3. The method as claimed in claim 1, wherein said centrifugal force is more than 30 G.

4. The method as claimed in claim 1, wherein said centrifugal force is more than 100 G.

5. The method as claimed in claim 1, wherein the liquid for treating the fibers is a dyeing solution or a decoloring solution.

6. The method as claimed in claim 1, wherein a position of the interface of the treating liquid is kept at a predetermined position to dye or decolor the piles in different color tones in the length direction of the piles.

7. The method as claimed in claim 6, wherein a position of the interface of the treating liquid is varied to dye or decolor the piles in different color tones in the length direction of the piles.

8. The method as claimed in claim 6, wherein the liquid for treating the fibers is a solvent or a solution of a decomposing agent for the piles.

9. The method as claimed in claim 8, wherein the piles are partially dissolved or decomposed and removed to make the fineness of the piles at the top portion and/or the root portion smaller than that of the central portion.

10. The method as claimed in claim 8 or 9, wherein the contact of the piles with the treating liquid is kept constant.

11. The method as claimed in claim 1, wherein the contact of the piles with the treating liquid is varied in time.

12. The method as claimed in claim 1, wherein two kinds of liquids for treating fibers are used, one treating liquid having a different specific gravity from another treating liquid, being not compatible with said another treating liquid and being inactive to the piles.

13. The method as claimed in claim 9, wherein the rotary shaft of said rotating body is concentric with the rotary shaft of the rotary container for retaining the treating liquid for the fibers and the relative position of the piles and the interface of the treating liquid is varied with time.

14. The method as claimed in claim 11, wherein the fibrous structure is moved on a supporter which is arranged in eccentric relation to the rotary shaft of the container for the treating liquid.

15. The method as claimed in claim 14, wherein the fibrous structure is moved while compensating for variation of the center of gravity.

16. A fur-like pile article comprising a substrate fabric, a mass of piles covering a broad area of said substrate fabric, said piles projecting from and forming a surface layer on said substrate fabric, said surface layer comprising a multiplicity of relatively short first piles of relatively small denier projecting upwardly from the substrate fabric and a multiplicity of relatively long second piles of relatively large denier projecting upwardly from the substrate fabric, said second piles being uniformly distributed among said first piles and projecting above the upper ends of said first piles, at least selected individual ones of said second piles being multicolor piles each having color portions of at least two different color tones distinguishable by the naked eye, said color portions of different color tones in each multicolor second pile being arranged lengthwise along the multicolor second pile and the change from one color tone to another color tone occurring within a distance of less than 4 mm in a direction lengthwise of the multicolor second pile, the zones in which all of said multicolor second piles change from one of said color tones to another of said color tones substantially lying on an imaginary plane substantially parallel with and spaced from said substrate fabric.

17. A fur-like pile article comprising a substrate fabric, a mass of piles covering a broad area of said substrate fabric, said piles protecting from and forming a surface layer on said substrate fabric, said surface layer comprising a multiplicity of relatively short first piles of relatively small denier projecting upwardly from the substrate fabric and a multiplicity of relatively long second piles of relatively large denier projecting upwardly from the substrate fabric, said second piles being uniformly distributed among said first piles and projecting above the upper ends of said first piles, at least selected individual ones of said second piles being multicolor piles each having color portions of at least two different color tones distinguishable by the naked eye, said color portions of different color tones in each multicolor second pile being separated from each other in a direction lengthwise of the multicolor second pile by an intermediate gradational portion in which the color tones gradually changes from one color tone to the other color tone so that the color tones at the opposite ends of said intermediate gradational portion smoothly merge with the color tones of said color portions, said intermediate gradational portions each having a length of more than 4 mm, the locations at which said intermediate gradational portions merge with said color portions substantially lying on imaginary planes substantially parallel with and spaced from said substrate fabric.

18. The pile article as claimed in claim 16 or 17, wherein the color tones differ by more than 1 in lightness (V).

19. The pile article as claimed in claim 16 or 17, wherein the color tones differ by more than 2 in chroma (C).

20. The pile article as claimed in claim 16 or 17, wherein the color tones differ by more than 2.5 in hue (H).

21. The pile article as claimed in claim 16 or claim 17, wherein more than 10% of said second piles are multicolor piles having color portions of at least two different color tones.

22. The pile article as claimed in claim 16 or claim 17, wherein more than 10% of said first piles are multicolor piles having color portions of at least two different color tones.

23. The pile article as claimed in claim 16 or 17, wherein there is one imaginary plane for change of color tone of said multicolor piles.

24. The pile article as claimed in claim 16 or 17, wherein there are a plurality of said imaginary planes for changes of color tone of said multicolor piles.

25. The pile article as claimed in claim 17, wherein the length of said intermediate gradational portion is from 5 to 60 mm.

26. The pile article as claimed in claim 17 or 25, wherein the difference of the lightness, the chroma or the hue from one end of said intermediate gradational portion to the other end thereof is more than 1, more than 2 or more than 2.5, respectively.

27. The pile article as claimed in claim 16 or claim 17, wherein more than 10% of said second piles and said first piles are said multicolor piles.

28. The pile article as claimed in claim 16 or claim 17, wherein more than 20% of said second piles and said first piles are said multicolor piles.

29. A pile article as claimed in claim 16 or claim 17 in which said first piles have a denier or less than 3 and the density of said first piles on said substrate fabric is from 10,000 to 50,000 filaments/cm$^2$, and said second piles have a denier of from 15 to 100 and the density of said second piles on said substrate fabric is from 100 to 1,000 filaments/cm$^2$.

30. A pile article as claimed in claim 16 or claim 17 in which said second piles are relatively fine at the opposite ends thereof, and the middle portions of said second piles are relatively thick.

* * * * *

UNITED STATES PATENT AND TRADEMARK OFFICE

CERTIFICATE OF CORRECTION

PATENT NO. : 4 459 128

DATED : July 10, 1984

INVENTOR(S) : Masao Matsui et al

It is certified that error appears in the above-identified patent and that said Letters Patent is hereby corrected as shown below:

Column 21, line 10; change "claim 6" to ---claim 1---.

Column 21, line 14; change "claim 6" to ---claim 1---.

Column 22, line 19; change "tones" to ---tone---.

Column 22, line 67; change "or" to ---of---.

Signed and Sealed this

*Twenty-sixth* Day of *February 1985*

[SEAL]

*Attest:*

DONALD J. QUIGG

*Attesting Officer*

*Acting Commissioner of Patents and Trademarks*